US006769265B1

(12) United States Patent
Davis et al.

(10) Patent No.: US 6,769,265 B1
(45) Date of Patent: Aug. 3, 2004

(54) VARIABLE SPEED REFRIGERATION SYSTEM

(75) Inventors: Kenneth E. Davis, Berwyn, IL (US); Alvin V. Miller, Swisher, IA (US); Joseph H. Ryner, New Windsor, IL (US); Kyle B. VanMeter, Galesburg, IL (US); Robert L. Wetekamp, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,480

(22) Filed: Mar. 12, 2003

(51) Int. Cl.[7] ..... F25D 17/04

(52) U.S. Cl. ..... 62/228.4; 62/187

(58) Field of Search ..... 62/228.3, 228.4, 62/229, 187, 179

(56) References Cited

U.S. PATENT DOCUMENTS

| | | | | |
|---|---|---|---|---|
| 3,005,321 | A | | 10/1961 | Devery |
| 3,447,747 | A | | 6/1969 | McHale |
| 3,559,422 | A | | 2/1971 | Holzer |
| 3,630,046 | A | | 12/1971 | Boor |
| 3,747,361 | A | | 7/1973 | Harbour |
| 3,759,051 | A | | 9/1973 | Ohnishi |
| 3,811,292 | A | | 5/1974 | Hoenisch |
| 3,815,378 | A | | 6/1974 | Hoenisch |
| 4,009,590 | A | | 3/1977 | Webb et al. |
| 4,009,591 | A | | 3/1977 | Hester |
| RE29,621 | E | | 5/1978 | Conley et al. |
| 4,177,649 | A | | 12/1979 | Venema |
| 4,257,238 | A | | 3/1981 | Kountz et al. |
| 4,282,720 | A | | 8/1981 | Stottmann et al. |
| 4,315,413 | A | | 2/1982 | Baker |
| 4,358,932 | A | | 11/1982 | Helfrich, Jr. |
| 4,467,618 | A | | 8/1984 | Gidseg |
| 4,481,787 | A | * | 11/1984 | Lynch ..... 62/180 |
| 4,485,635 | A | | 12/1984 | Sakano |
| 4,646,531 | A | | 3/1987 | Song |
| 4,646,534 | A | | 3/1987 | Russell |
| 4,662,185 | A | | 5/1987 | Kobayashi et al. |
| 4,732,010 | A | | 3/1988 | Linstromberg et al. |
| 4,734,628 | A | | 3/1988 | Bench et al. |
| 4,765,150 | A | | 8/1988 | Persem |
| 4,819,442 | A | | 4/1989 | Sepso et al. |
| 4,834,169 | A | | 5/1989 | Tershak et al. |
| 4,843,833 | A | | 7/1989 | Polkinghorne |
| 4,959,969 | A | | 10/1990 | Okamoto et al. |
| 5,018,364 | A | | 5/1991 | Chesnut et al. |
| 5,172,566 | A | | 12/1992 | Jung et al. |
| 5,201,888 | A | | 4/1993 | Beach, Jr. et al. |
| 5,228,300 | A | | 7/1993 | Shim |
| 5,231,847 | A | | 8/1993 | Cur et al. |
| 5,253,483 | A | | 10/1993 | Powell et al. |
| 5,255,529 | A | | 10/1993 | Powell et al. |
| 5,255,530 | A | | 10/1993 | Janke |
| 5,257,508 | A | | 11/1993 | Powell et al. |
| 5,269,152 | A | | 12/1993 | Park |
| 5,375,428 | A | | 12/1994 | LeClear et al. |
| 5,377,498 | A | | 1/1995 | Cur et al. |
| 5,460,009 | A | | 10/1995 | Wills et al. |

(List continued on next page.)

FOREIGN PATENT DOCUMENTS

| | | |
|---|---|---|
| JP | 404302976 A | 10/1992 |
| JP | 5-196340 | 8/1993 |

*Primary Examiner*—Marc Norman
(74) *Attorney, Agent, or Firm*—Diederiks & Whitelaw, PLC

(57) ABSTRACT

A refrigerator incorporates a variable speed refrigeration system including a variable speed compressor, an evaporator fan, a fresh food compartment stirring fan and a multi-position damper. Various temperature sensors are provided to sense system parameters which are used by a controller to regulate each of the variable components in order to compensate for temperature changes within a refrigerator compartment and, maintain the compartment within a confined temperature band, in a highly effective, energy efficient and synergistic manner.

26 Claims, 4 Drawing Sheets

U.S. PATENT DOCUMENTS 5,548,969 A 8/1996 Lee
5,555,736 A 9/1996 Wills et al.
5,586,444 A 12/1996 Fung
5,678,416 A 10/1997 Yoo et al.
5,711,159 A 1/1998 Whipple, III
5,715,693 A 2/1998 van der Walt et al.
6,038,874 A 3/2000 van der Walt et al.
6,691,524 B2 * 2/2004 Brooke ..... 62/180

* cited by examiner

VARIABLE SPEED REFRIGERATION SYSTEM

BACKGROUND OF INVENTION

1. Field of Invention

The present invention pertains to the art of refrigerated appliances and, more particularly, to a refrigerator including a variable speed compressor that, in combination with a controller, efficiently maintains fresh food compartment temperatures within a confined temperature band.

2. Discussion of Prior Art

In general, a refrigerator includes a first or freezer compartment for maintaining foodstuffs at or below freezing, and a second or fresh food compartment, in fluid communication with the freezer compartment, for maintaining foodstuffs in a temperature zone between ambient and freezing temperatures. A typical refrigerator includes a refrigeration system having a compressor, a condenser coil, a condenser fan, an evaporator coil, and an evaporator fan.

In operation, temperature sensors are provided within the refrigerator to measure internal temperatures of the appliance. When a door associated with either compartment is opened, the temperature within the respective compartment will rise. When the internal temperature of the refrigerator deviates from a predetermined temperature, the refrigeration system is caused to operate such that the temperature will return to a point below a consumer selected set-point. In order to return the compartment temperature to this point, prior art systems are caused to operate at maximum capacity regardless of the degree of the deviation. Another consideration is the size of the temperature zone. Prior art refrigerators typically establish a wide temperature zone or bounce region in order to minimize operation of the refrigeration system. A small temperature zone or bounce region results in extended operation of the system, thereby reducing energy efficiency.

A supplement to compressor operation is the addition of a variable position damper located between an evaporator housing and the fresh food compartment. Operation of the damper is controlled such that cool air is permitted to flow from the evaporator to the fresh food compartment. In some arrangements, a fan is mounted within a housing adjacent to the evaporator to aid in establishing the air flow. Accordingly, if the temperature of the fresh food compartment rises above the set-point, the damper is operated to allow the passage of cooling air from the evaporator compartment to the fresh food compartment. Unfortunately, this results in operation of the compressor each time additional cooling air is required.

Earlier systems require running the refrigeration system at its maximum level in order to lower the temperatures in the compartments. As time progressed, systems were developed which varied the speed of one or another of the individual refrigeration components, e.g. the compressor, the condenser fan, and/or evaporator fan, depending upon the magnitude of the temperature deviation. Additionally, a fan is incorporated into a chamber adjacent to the fresh food compartment to recirculate air within the compartment in order to reduce temperature stratification.

While these systems work to improve refrigeration efficiency, they have never been fully integrated so as to obtain a synergistic benefit, with each component being operated in a manner to maximize the efficiency of the refrigerated appliance. Nor are the various components designed to be operated by a control system specifically designed to determine the energy maximizing speed for the compressor based on predicted temperature values, the rate of temperature change in each of the fresh food and freezer compartments and the overall system design. Accordingly, there exists a need for a refrigeration system which varies the speed of the compressor based on a method of control such that maximum efficiency is achieved.

SUMMARY OF THE INVENTION

A refrigerator constructed in accordance with the present invention is energy efficient, having a reduced noise output and minimal thermal stratification. In addition to the typical components found in a refrigerator, e.g. an insulated cabinet shell having a fresh food compartment and a freezer compartment, shelves for supporting food items, and in some arrangements drawers for storing fruit, vegetables and meats, the refrigerator of the present invention includes an electronic control system capable of operating a refrigeration system for maintaining one or more of the compartments at a substantially constant temperature with minimal energy input.

To this end, the refrigerator of the present invention includes a variable speed compressor, an evaporator fan, and a fresh food stirring fan. Additionally, a multi-position damper is located within a duct connecting the fresh food and freezer compartments for controlling a flow of cooling air between the two compartments. The refrigeration components are interconnected to the electronic control system which receives signals from a plurality of sensors and functions to vary the speed of the compressor such that the refrigeration system operates to maintain the temperature of the compartments with minimum compartment temperature variations and, in the case of fresh food compartment, within a confined temperature band.

During normal usage, the refrigerator will be accessed several times a day through the opening and closing of at least one compartment door. This opening and closing results in a rise in an internal temperature of the appliance. Furthermore, the addition of various loads, i.e. foodstuffs into each of the compartments will also increase compartment temperature. When internal compartment temperatures exceed a predetermined limit, sensors send a signal representative of that temperature change to the electronic control system. Based upon the magnitude and direction of the temperature change, the electronic control system determines not only which component(s) require activation, but also the optimum speed at which the compressor should be operated. Therefore, for example, a low cooling demand results in a low speed operation, a medium cooling requirement results in a medium speed operation, etc. However, the operation of the components are interdependent such that temperature control is performed in a synergistic manner. For instance, the operational speed of the compressor is established based on sensed temperatures in the freezer and fresh food compartments, the rate of change of the temperature in the freezer compartment, the rate of change of the freezer compartment temperature relative to a set point, the rate of change of the temperature in the fresh food compartment, the rate of change of the fresh food compartment relative to a set point and, if so equipped, a set point temperature of one or more high performance specialty compartments.

Based on the above, it is the manner in which the electronic control varies the operational speed of the compressor based on estimated and sensed temperature conditions in order to maximize operational efficiency to which the invention is directed. In any event, additional objects, features and advantages of the invention will become more readily apparent from the following detailed description of a preferred embodiment of the invention when taken in conjunction with the drawings wherein like reference numerals refer to corresponding parts in the several views.

DETAILED DESCRIPTION OF THE INVENTION

Figure 1:
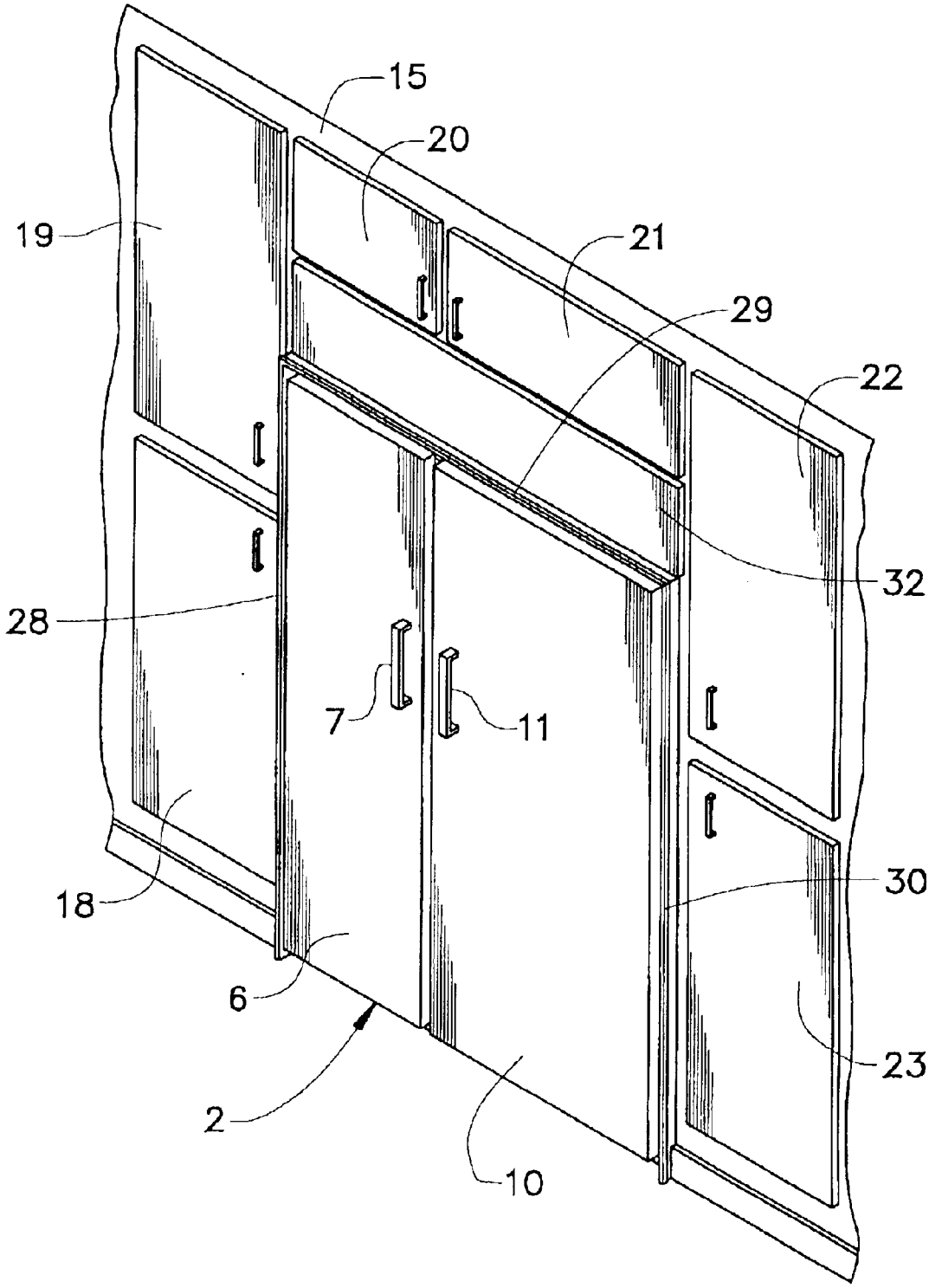
FIG. 1 is a perspective view of a refrigerator incorporating the variable speed refrigeration system of the invention.

With initial reference to FIG. 1, a refrigerator constructed in accordance with the present invention is generally shown at 2. Refrigerator 2 is shown to include a freezer door 6 having an associated handle 7 and a fresh food door 10 having an associated handle 11. In the embodiment shown, refrigerator 2 is of the recessed type such that, essentially, only freezer and fresh food doors 6 and 10 project forward of a wall 15. The remainder of refrigerator 2 is recessed within wall 15 in a manner similar to a plurality of surrounding cabinets generally indicated at 18–23. Refrigerator 2 also includes a plurality of peripheral trim pieces 28–30 to blend refrigerator 2 with cabinets 18–23. One preferred embodiment employs trim pieces 28–30 as set forth in U.S. Patent Application entitled "Fastening System for Appliance Cabinet Assembly" filed on even date herewith and which is incorporated herein by reference. Finally, as will be described more fully below, refrigerator 2 is preferably designed with main components of a refrigeration system positioned behind an access panel 32 arranged directly above trim piece 29.

Figure 2:
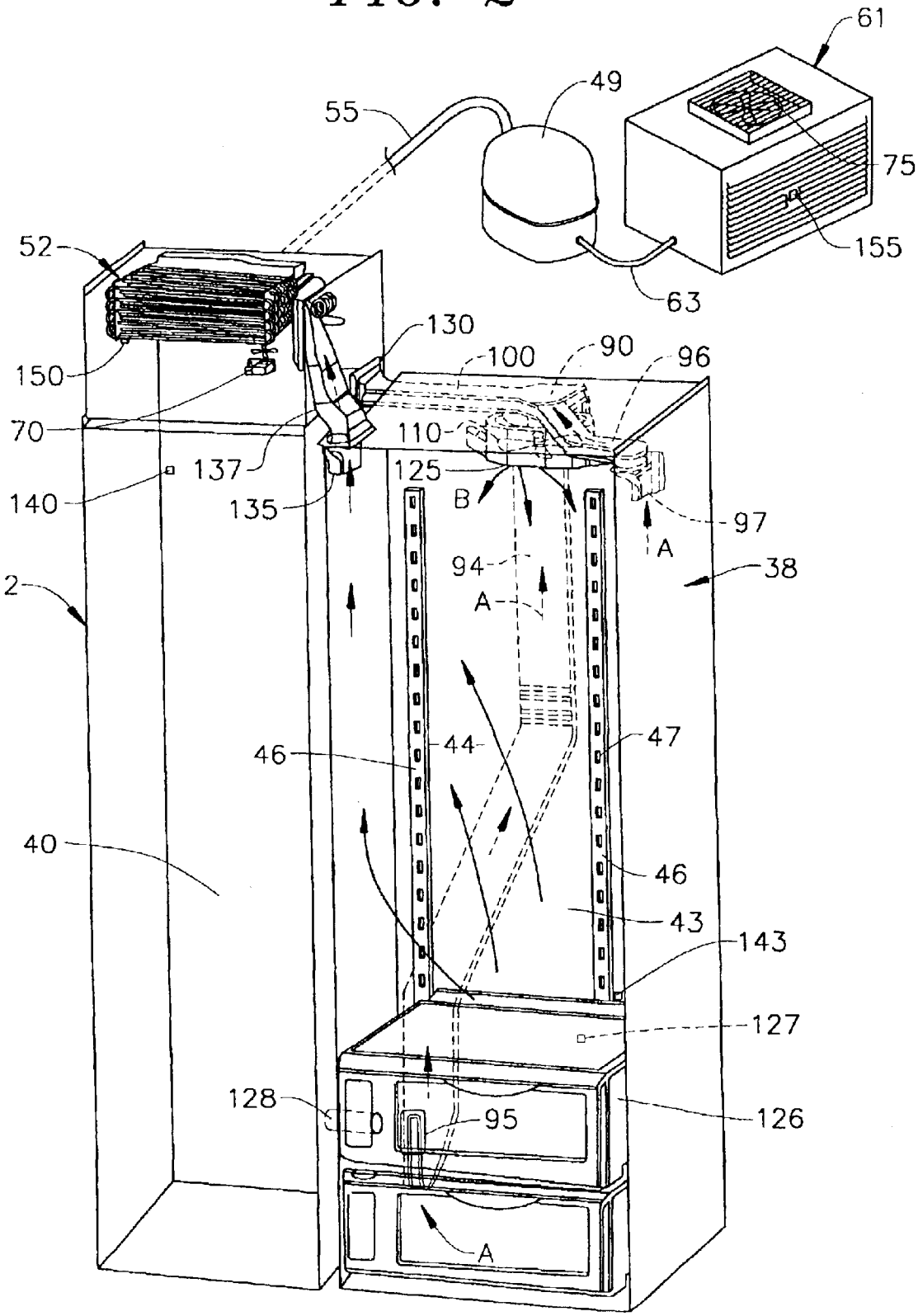
FIG. 2 is an exploded view showing the various components of the variable speed refrigeration system in accordance with a preferred embodiment of the present invention.

As shown in FIG. 2, refrigerator 2 includes a cabinet shell 38 defining a freezer compartment 40 and a fresh food compartment 43. For details of the overall construction of cabinet shell 38, reference is again made to U.S. Patent Application entitled "Fastening System for Appliance Cabinet Assembly" filed on even date herewith and incorporated by reference. Shown arranged on a rear wall 44 of fresh food compartment 43 are a plurality of elongated metal shelf rails 46. Each shelf rail 46 is provided with a plurality of shelf support points, preferably in the form of slots 47, adapted to accommodate a plurality of vertically adjustable, cantilevered shelves (not shown) in a manner known in the art. Since the manner in which such shelves can vary and is not considered part of the present invention, the shelves have not been depicted for the sake of clarity of the drawings and will not be discussed further here. However, for purposes which will be set forth further below, it should be noted that each of rails 46 preferably extends from an upper portion, through a central portion, and down into a lower portion (each not separately labeled) of fresh food compartment 43.

Preferably mounted behind access panel 32 are components of the refrigeration system employed for refrigerator 2. More specifically, the refrigeration system includes a variable speed compressor 49 which is operatively connected to both an evaporator 52 through conduit 55, and a condenser 61 through conduit 63. Arranged adjacent to evaporator 52 is an evaporator fan 70 adapted to provide an airflow to evaporator 52. Similarly, arranged adjacent to condenser 61 is a condenser fan 75 adapted to provide an airflow across condenser 61. In accordance with the invention, the variable speed compressor 49 is operated at a respective optimum speed based upon sensed cooling demand within refrigerator 2 as will be detailed fully below.

In addition to the aforementioned components, mounted to an upper portion of fresh food compartment 43 is an air manifold 90 for use in directing a cooling airflow through fresh food compartment 43 of refrigerator 2. More specifically, a first recirculation duct 94 having an inlet 95 exposed in a lower portion of fresh food compartment 43, a second recirculation duct 96 having an inlet 97 exposed at an upper portion of fresh food compartment 43, and an intake duct 100 establishing an air path for a flow of fresh cooling air from freezer compartment 40 into manifold 90. Arranged in fluid communication with air manifold 90 is a fresh food stirring fan 110. Stirring fan 110 is adapted to receive a combined flow of air from recirculation ducts 94 and 95, as well as intake duct 100, and to disperse the combined flow of air into the fresh food compartment 43. In this way, very cold air from inlet duct 100 is mixed with recirculated air from ducts 94 and 95 to create a slightly cooler air mixture for discharge into fresh food compartment 43 in order to minimize temperature stratification.

In accordance with the most preferred form of the invention, stirring fan I 10 is operated continuously. With this arrangement, stirring fan I 10 draws in a flow of air, which is generally indicated by arrows A, through inlets 95 and 97 of ducts 94 and 96, and intake duct 100, while subsequently exhausting the combined flow of cooling air, represented by arrow B, through outlet 125. Most preferably, outlet 125 directs the air flow in various directions in order to generate a desired flow pattern based on the particular configuration of fresh food compartment 43 and any additional structure provided therein. The exact positioning of inlets 95 and 97 also depend on the particular structure provided. In one preferred embodiment, inlet 95 of duct 94 is located at a point behind at least one high performance storage compartment 126 having an associated temperature sensor 127 arranged in a bottom portion of fresh food compartment 43. With this construction, an operator can establish a temperature setting for high performance storage compartment 126 independent from the temperature of the fresh food compartment. The air flow past the high performance storage compartment 126 is provided to aid in maintaining freshness levels of food contained therein. For this purpose, an additional passage leading from freezer compartment 40 into fresh food compartment 43 can be provided as generally indicated at 128. While not part of the present invention, the details of the high performance storage compartment 126 are described in U.S. Pat. No. 6,170,276 which is hereby incorporated by reference.

In order to regulate the amount of cooling air drawn in from freezer compartment 40, a multi-position damper 130 is provided either at an entrance to or at a location within intake duct 100. As will be discussed more fully below, when the cooling demand within fresh food compartment 43 rises, multi-position damper 130 opens to allow cooling air to flow from freezer compartment 40 to fresh food compartment 43 and, more specifically, into intake duct 100 to manifold 90 and stirring fan 10. A flow of air to be further cooled at evaporator 52 is lead into an intake 135 of a return duct 137. In the embodiment shown, return duct 137 is preferably located in the upper portion of fresh food compartment 43.

In accordance with the invention, this overall refrigeration system operates to both maintain the temperature within fresh food compartment 43 at a substantially uniform temperature, preferably established by an operator, and minimizes stratification of the temperature in fresh food compartment 43. In order to determine the cooling demand within freezer compartment 40 and fresh food compartment 43, a plurality of temperature sensors are arranged throughout refrigerator 2. Specifically, a freezer temperature sensor 140 is located in freezer compartment 40, a fresh food compartment temperature sensor 143 is mounted on shelf rail 46, an evaporator coil temperature sensor 150 is mounted adjacent to evaporator 52, and a sensor 155, which is preferably arranged in a position directly adjacent to an intake associated with condenser 61, is provided to measure the ambient air temperature.

As indicated above, shelf rails 46 are preferably made of metal, thereby being a good conductor. As will become more fully evident below, other high conductive materials could be employed. In addition, shelf rails preferably extend a substantial percentage of the overall height of fresh food compartment 43. In this manner, the temperature sensed by sensor 143 is representative of the average temperature within fresh food compartment 43. Certainly, an average temperature reading could be obtained in various ways, such as by averaging various temperature readings received from sensors located in different locations throughout fresh food compartment 43. However, by configuring and locating sensor 143 in this manner, an average temperature reading can be obtained and the need for further, costly temperature sensors is avoided. Actually, although not shown, freezer temperature sensor 140 is also preferably provided at a corresponding freezer shelf-rail for similar purposes.

Figure 3:
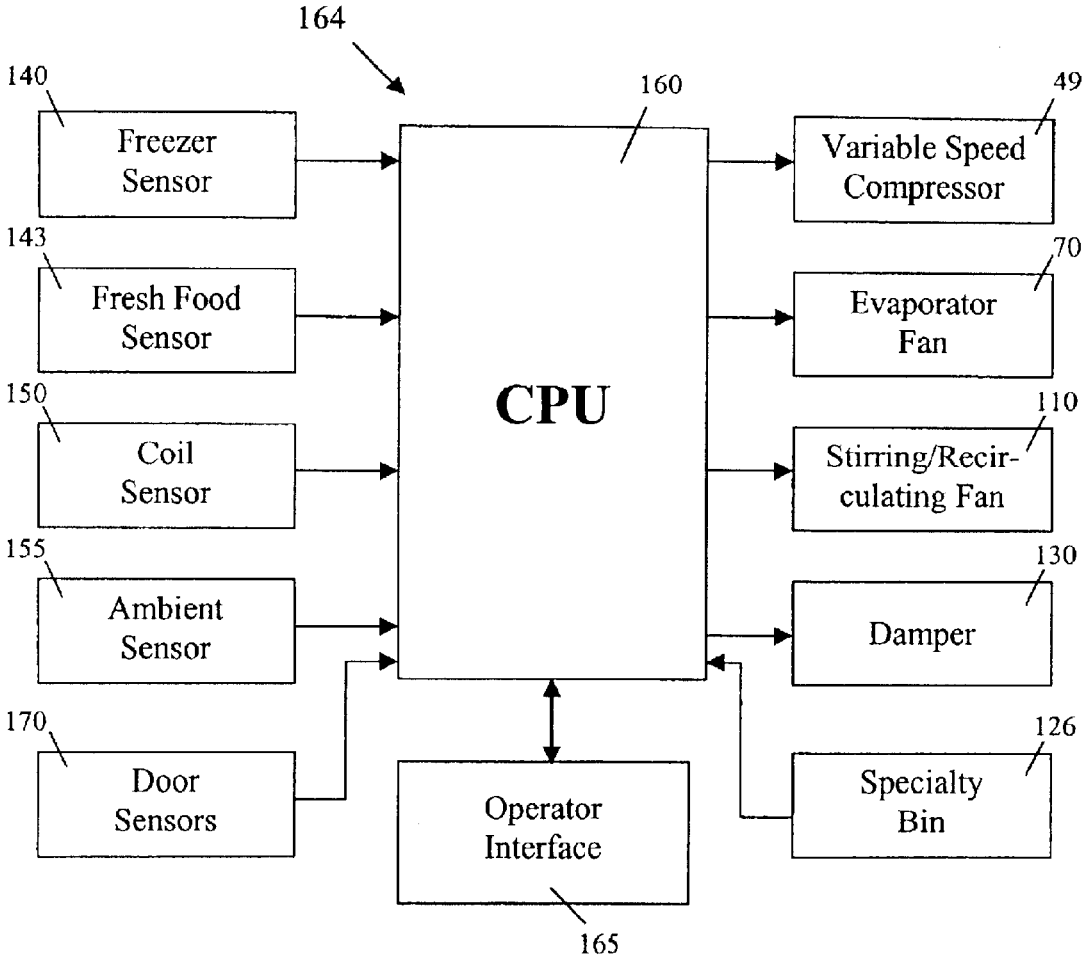
FIG. 3 is a block diagram depicting the interrelationships of the control system components of the preferred embodiment of the invention.

As shown in FIG. 3, a controller or CPU 160, forming part of an overall control system 164 of refrigerator 2, is adapted to receive inputs from each of the plurality of temperature sensors 140, 143, 150 and 155, as well as operator inputs from an interface 165, and functions to regulate the operational speed of variable speed compressor 49, as well as the operation of evaporator fan 70, and stirring fan 110, as well as the position for damper 130, in order to maintain a desired temperature throughout fresh food compartment 43. At this point, it should be noted that interface 165 can take various forms in accordance with the invention. For instance, interface 165 could simply constitute a unit for setting a desired operating temperature or set point for freezer compartment 40 and/or fresh food compartment 43, such as through the use of push buttons or a slide switch. In one preferred form of the invention, although not shown in FIG. 1, interface 165 is constituted by an electronic control panel mounted on either door 6 or 10 including a number of control elements which enable an operator to enter desired operating temperatures and a digital display to show temperature set points and/or actual compartment temperatures. Additionally, the display could incorporate a consumer operated switch to change the displays from ° F. to ° C. and vise versa, indicate various alarm indications, such as power interruption and door ajar indicators, service condition signals and, in models incorporating water filters, a filter change reminder. In any event, it is simply important to note that various types of interfaces could be employed in accordance with the invention.

In general, temperature fluctuations within refrigerator 2 can cover a broad spectrum. During a typical day, doors 6 and 10 of refrigerator 2 can be opened several times and for varying periods of time as sensed by door sensors 170. Each time a door 6, 10 is opened, cold air escapes from a respective compartment 40, 43 and the temperature within the compartment 40, 43 is caused to rise. In many cases, foodstuffs are inserted into a compartment which further contributes to the temperature rise. A temperature rise, which exceeds a predetermined limit, will necessitate the activation of the refrigeration system in order to compensate for the cooling loss. However, each door opening or introduction of food, does not release the same amount of cold air or contribute equally to the cooling load, and therefore a uniform level of temperature compensation will not be needed. Accordingly, control system 164 determines the required cooling load and maintains the temperature within first compartment 43 in a predetermined, small temperature range by regulating the operational speed of compressor 49, activating stirring fan 110, and/or opening multi-position damper 130. That is, controller or CPU 160 regulates the operational speed of compressor 49 and establishes the proper damper position interdependently, as will be detailed below, thereby obtaining synergistic results for the overall temperature control system. In fact, it has been found that fresh food compartment 43 can be reliably maintained within a confined temperature band as small a temperature range of 1° F. (approximately 0.56° C.) from a desired set point temperature in accordance with the invention.

As indicated above, temperature sensor 143 monitors the average temperature at shelf rail 146 and sends representative signals to CPU 160 at periodic intervals to reflect an average temperature within fresh food compartment 43. Controller or CPU 160 preferably takes a derivative of the sensed temperatures to develop a temperature gradient or slope representative of a rate of change of the temperature within fresh food compartment 43. As will be detailed mote fully below, based upon the magnitude and direction of the slope, CPU 160 operates each of the components of refrigerator 2 to maintain respective freezer and fresh food compartment 40, 43 temperatures. In accordance with the most preferred form of the invention, this deviation is taken approximately every 30 seconds.

Figure 4:
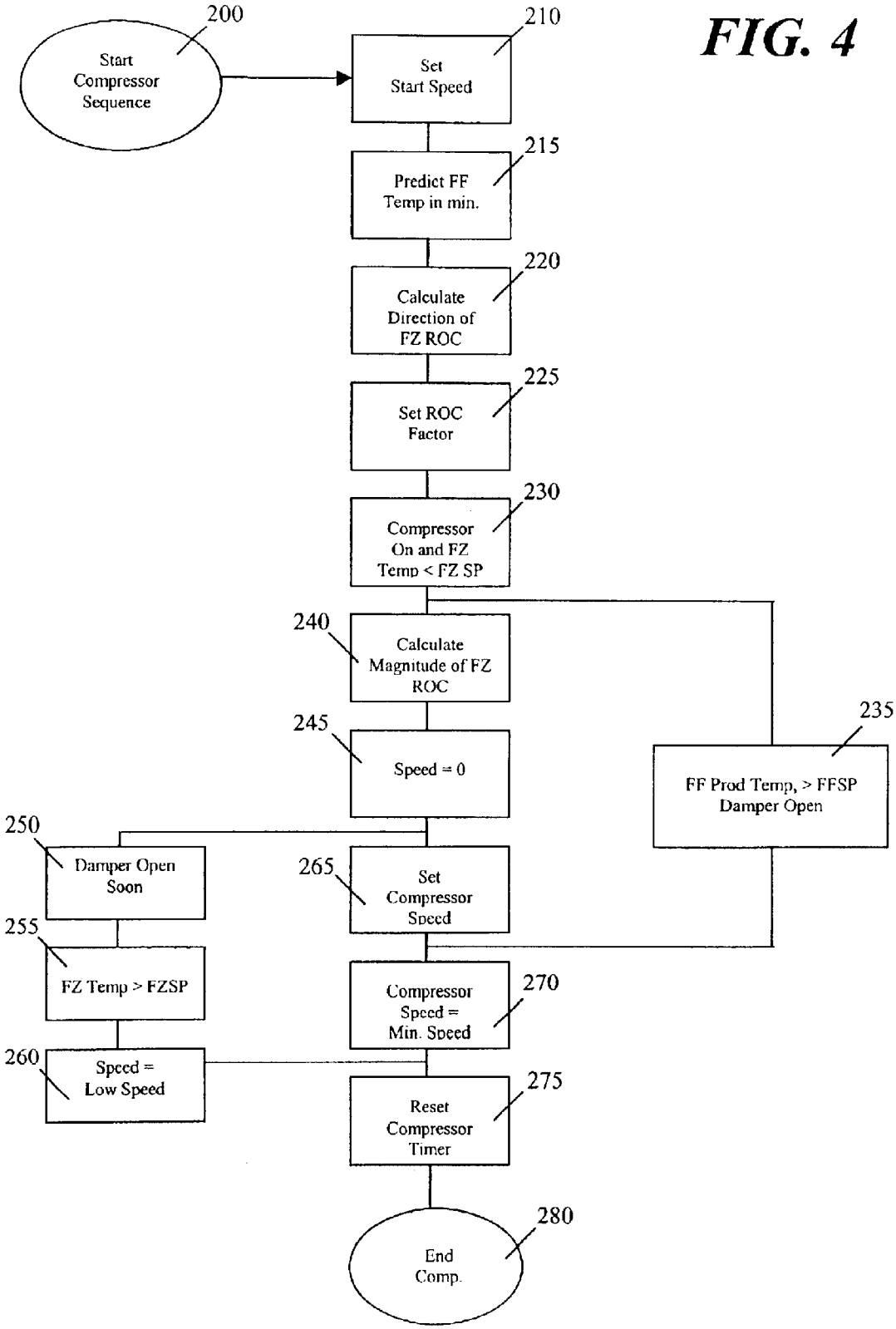
FIG. 4 is a flow-chart depicting the operation of the variable speed refrigeration system in accordance with a preferred embodiment of the present invention.

As shown in FIG. 4, upon sensing a cooling requirement, controller 160 initiates a start compressor sequence 200. Initially, start compressor sequence 200 sets the start speed 210 of variable speed compressor 49, e.g. 2200 RPM. At this point, controller 160 calculates and predicts in step 215 what the fresh food compartment temperature will be at the termination of a predetermined time period, e.g. a seven minute time period. In order to perform this calculation, controller 160 calculates a current fresh food temperature which, in the most preferred form of the invention, is a regression model of the fresh food temperature that includes various components of, for example, the output of the fresh food sensor 143, ambient sensor 155, freezer sensor 140 and specialty compartment sensor 127. In an exemplary model, the fresh food temperature regression includes components in the following percentages: 83% of the sensed fresh food temperature, 2% ambient temperature, 10% freezer temperature and 5% specialty compartment temperature. Using the calculated value and the rate of change of the fresh food temperature, controller 160 determines or predicts what the fresh food temperature will be at the end of the predetermined time period.

At this point, controller 160 establishes a rate of change multiplying factor in step 220 by determining the direction of the rate of change (ROC) within the freezer compartment. That is, in step 220, controller 160 evaluates the rate of change to determine whether the fresh food compartment temperature is rising or falling. As the compressor has a greater capacity to remove heat than the ability for heat to enter a compartment, if it is determined that the direction of the temperature change is negative, (an indication that the temperature is falling), a first multiplying factor will be set, for example 8, such that variable speed compressor 49 is operated at a lower speed. In contrast, if it is determined that the rate of change is positive (an indication that the temperature within the compartment is increasing), a second multiplying factor will be set, for example 3, such that variable speed compressor 49 will operate at a greater speed (step 225). Next in sequence 200, controller 160 determines the operational state of compressor 49 in step 230.

If in step 230, it controller 160 determines that the compressor is operating and freezer compartment temperature is below the set-point, sequence 200 advanced to step 235. Due to a necessary time delay in restarting variable speed compressor 49 after deactivation, the operational sequence will make a determination whether the predicted fresh food compartment temperature is greater than the fresh food compartment set point or whether the damper is open in step 235. If controller 160 determines that either the predicted fresh food temperature is substantially exceeds than the fresh food set point, e.g. if the predicted fresh food temperature exceeds the fresh food set point by 1.5° F. (0.84° C.), or if damper 130 is open, compressor sequence 200 will force a continued operation of variable speed compressor 49 despite a signal to the contrary. If neither of the above factors are found, then in accordance with the present invention, in order to maintain the fresh food compartment temperature within the confined energy ban, the operational must adjust the activation and deactivation point for compressor 49. Toward that end, in step 240, controller 160 determines the magnitude of the rate of change (ROC) of the freezer compartment temperature. In this manner, sequence 200 can compensate for the effects of thermal inertia which might otherwise cause the temperature of the fresh food compartment to deviate from the confined temperature band.

In accordance with the most preferred form of the invention, to further maintain the fresh food compartment temperature within the confined temperature band controller 160, in step 245, evaluates the current speed of compressor 49. If controller 160 determines that the speed of compressor 49 is greater than zero, than the operational advances to steps 250–260 and evaluates the position of damper 130 and the likelihood of an imminent opening, and whether the current freezer temperature is greater than the freezer set point in step 255. If controller 160 determines that either of the aforementioned conditions exist, compressor speed will be set at a low speed level (step 260) such that excessive cooling, or operating compressor 49 at a capacity greater than that necessary, will not occur. In this manner, similar to that stated above, the effects of thermal inertia will not carry the fresh food compartment temperature outside the 1° F. (0.56° C.) target band. However, if it is determined that none of the conditions in steps 250 and 255 exist, controller 160 will set the compressor speed to an optimum level in step 265 based in part upon the fresh food compartment set point, freezer compartment set point, rate of change of temperature in the fresh food compartment, rate of change in temperature of the freezer compartment as well as ambient temperature and, if so equipped, the temperature of the specialty compartment(s).

At this point controller 160 will continue to optimize the speed of compressor 49 until the temperature within the fresh food compartment and freezer compartment approach the desired set points. As the set points are achieved, compressor speed is gradually decreased until achieving a minimum compressor speed in step 270, at which time controller 160 determines that deactivation of compressor 49 is necessary. Prior to deactivating compressor 49, a timer is reset, in step 275 which prevents activation of the compressor until internal compressor pressures have stabilized. Preferably, the timer prevents reactivation of compressor 49 for a preset period, e.g., four minutes. Of course, it must be understood that this time delay is dependent on the particular model of compressor used. At this point, step 280 cuts off power to compressor 49 until it is determined that additional cooling is required back in step 200.

Based on the above, it should be readily apparent that the invention provides for an variable speed refrigeration system of the type which enables refrigerator compartments to be maintained within a confined temperature band temperatures, minimizes and makes efficient use of energy, and addresses reducing the amount of noise emitted to the surroundings. Even though the variable speed compressor is controlled individually through CPU 160, CPU 160 operates the compressor, and other refrigeration components, based on the collective information received by the plurality of sensors such that synergistic results are obtained. Therefore, refrigerator 2 constructed in accordance with the present invention reduces the amount of energy consumed as compared to similar appliances. A quick opening of a compartment door will not require the refrigeration system to operate at full speed to compensate for the temperature loss. Instead, any temperature variations are continuously addressed by the operation of the variable speed compressor, the damper, and the stirring fan such that even slight temperature deviations are appropriately compensated in a proactive fashion. In this manner, and with the overall ducting arrangement employed, temperature stratification within the fresh food compartment is substantially eliminated, and a uniform temperature can be maintained throughout the compartment. In any event, although described with. reference to a preferred embodiment, it should be understood that various changes and/or modifications can be made to the invention without departing from the spirit thereof. Instead, the invention is only intended to be limited by the scope of the following claims.

We Claim:

1. A refrigerator comprising:

a cabinet shell including a fresh food compartment and a freezer compartment;

a passage for fluidly interconnecting said fresh food compartment with said freezer compartment;

a damper provided in the passage for directing a flow of cooling air to the fresh food compartment from the freezer compartment;

a refrigeration system for cooling the freezer compartment, said refrigeration system including at least a compressor, an evaporator, an evaporator fan, a condenser and a fresh food stirring fan, said compressor being operable at varying speeds;

a plurality of sensors for detecting various operating parameters of the refrigerator; and a controller means interconnected to each of the refrigeration system and the plurality of sensors, said controller means functioning to vary the speed of the compressor based on at least one of a fresh food compartment set point, a freezer compartment set point, a rate of change of temperature in the fresh food compartment and a rate of change of temperature in the freezer compartment wherein, the controller regulates the speed of the compressor to maintain a temperature in the fresh food compartment in a confined temperature band.

2. The refrigerator according to claim 1, wherein one of the plurality of sensors constitutes a temperature sensor mounted within the fresh food compartment for sensing the temperature in the fresh food compartment.

3. The refrigerator according to claim 2, further comprising: at least one shelf rail extending vertically along a rear portion of the fresh food compartment, said fresh food compartment temperature sensor being mounted to the at last one shelf rail.

4. The refrigerator according to claim 2, wherein one of the plurality of sensors constitutes a temperature sensor mounted at an intake of the condenser for sensing an ambient temperature.

5. The refrigerator according to claim 2, further comprising: at least one specialty compartment arranged within the fresh food compartment, said specialty compartment including a control for establishing a specialty compartment set-point temperature independent from the fresh food compartment set-point temperature.

6. The refrigerator according to claim 5, wherein the controller calculates a predicted fresh food temperature, said predicted fresh food temperature being based in part upon a combination of the fresh food temperature, the freezer temperature, the ambient temperature and the specialty compartment set point temperature.

7. The refrigerator according to claim 6, wherein one of the plurality of sensors constitutes an ambient temperature sensor, wherein said predicted fresh food temperature is further based on the ambient temperature.

8. The refrigerator according to claim 7, wherein the predicted temperature is an estimated value representing what the fresh food compartment temperature will be at the end of a seven minute time period.

9. The refrigerator according to claim 1, wherein the controller means establishes a rate of change multiplying factor based upon the direction of the rate of change of the freezer compartment temperature, said rate of change multiplying factor being utilized to set compressor operational speed.

10. The refrigerator according to claim 9, wherein the rate of change multiplying factor equals three if the direction of the rate of change is positive.

11. The refrigerator according to claim 10, wherein the rate of change factor equals eight if the direction of the rate of change is negative.

12. The refrigerator according to claim 9, wherein the controller means calculates a magnitude of the rate of change of the fresh food compartment temperature, said controller means alters an activation state of the compressor based upon the magnitude of the rate of change of the fresh food compartment temperature.

13. The refrigerator according to claim 9, wherein the controller means operates the compressor despite a signal calling for compressor deactivation if the predicted fresh food temperature is greater than the fresh food set point.

14. The refrigerator according to claim 13, wherein the controller means operates the compressor despite a signal calling for compressor deactivation if the damper is in an open state.

15. The refrigerator according to claim 1, wherein the confined temperature band is within one degree Fahrenheit of the fresh food compartment set point.

16. The refrigerator according to claim 1, wherein the controller means varies the operational speed of the compressor based on each of a fresh food compartment set point, a freezer compartment set point, a rate of change of temperature in the fresh food compartment and a rate of change of temperature in the freezer compartment.

17. A method of maintaining a first compartment of a refrigerator within a confined temperature band, said first compartment being in fluid communication with a second compartment of the refrigerator comprising:

determining a temperature in the first compartment;

calculating a rate of change of the temperature in the first compartment;

determining a temperature in the second compartment;

calculating a rate of change of the temperature in the second compartment; and operating a variable speed compressor at a speed which will cause the temperature of the first compartment to remain within the confined temperature band.

18. The method according to claim 17, wherein the confined temperature band is within approximately 1° F. (about 0.56° C. of a first compartment set point.

19. The method according to claim 17, further comprising: employing a regression model which accounts for various operational parameters of the refrigerator in determining the temperature in the first compartment.

20. The method according to claim 19, wherein the operational parameters include first compartment temperature, second compartment temperature, ambient air temperature and a temperature within a specialty compartment provided in the refrigerator.

21. The method according to claim 17, further comprising:

predicting the temperature of the first compartment at the end of a predetermined time period; and controlling the operational speed of the compressor based, at least in part, upon the predicted temperature.

22. The method according to claim 21, wherein the predetermined time period is approximately seven minutes.

23. The method according to claim 21, further comprising: operating the compressor at a low speed, irrespective of a signal calling for the termination of compressor operation, if the temperature predicted for the first compartment is greater than a set point temperature and the damper is open.

24. The method according to claim 17, further comprising: determining a magnitude and direction of the rate of change of the temperature in the first compartment.

25. The method according to claim 24, further comprising:

setting a rate of change multiplying factor based on the direction of the rate of the temperature in the first compartment; and operating the compressor at a speed based on the rate of change multiplying factor.

26. The method according to claim 17, further comprising: initializing a timer to delay reactivation of the compressor after operation of the compressor has terminated.

* * * * *